US010745916B2

(12) United States Patent
Hayes et al.

(10) Patent No.: US 10,745,916 B2
(45) Date of Patent: Aug. 18, 2020

(54) INTERMEDIATE COUPLER FOR CONCRETE REINFORCEMENT

(71) Applicant: PRECISION-HAYES INTERNATIONAL INC., Seagoville, TX (US)

(72) Inventors: Norris Hayes, Katy, TX (US); Paul Hohensee, West Bend, WI (US); Thomas Mathews, Midlothian, TX (US); Tim Beaver, Sugar Land, TX (US)

(73) Assignee: PRECISION-HAYES INTERNATIONAL INC., Seagoville, TX (US)

( * ) Notice: Subject to any disclaimer, the term of this patent is extended or adjusted under 35 U.S.C. 154(b) by 0 days.

(21) Appl. No.: 16/402,720

(22) Filed: May 3, 2019

(65) Prior Publication Data

US 2019/0338523 A1 Nov. 7, 2019

Related U.S. Application Data

(60) Provisional application No. 62/666,530, filed on May 3, 2018.

(51) Int. Cl.

| | |
|---|---|
| ***E04C 5/12*** | (2006.01) |
| ***E04C 5/02*** | (2006.01) |
| ***E04C 5/16*** | (2006.01) |

(52) U.S. Cl.

CPC ..... *E04C 5/122* (2013.01); *E04C 5/02* (2013.01); *E04C 5/161* (2013.01); *E04C 5/163* (2013.01); *E04C 5/165* (2013.01)

(58) Field of Classification Search

CPC . E04C 5/163; E04C 5/02; E04C 5/161; E04C 5/165; E04C 5/122; E04C 5/12; E04G 21/12

See application file for complete search history.

(56) References Cited

U.S. PATENT DOCUMENTS

| | | | | |
|---|---|---|---|---|
| 3,850,535 A | | 11/1974 | Howlett et al. | |
| 4,318,256 A | * | 3/1982 | Boonman | E04G 21/12 52/223.13 |

(Continued)

FOREIGN PATENT DOCUMENTS

| | | | | |
|---|---|---|---|---|
| CA | 2368512 A1 | * | 9/2001 | E04C 5/122 |
| DE | 102014008166 A1 | * | 12/2015 | F16B 13/08 |
| WO | 9208019 A1 | | 5/1992 | |

OTHER PUBLICATIONS

Extended European Search Report issued in EP App. No. 19172644.7, dated Aug. 29, 2019 (11 pages).

*Primary Examiner* — Jessie T Fonseca

(74) *Attorney, Agent, or Firm* — Adolph Locklar

(57) ABSTRACT

A coupler may include a first chuck, the first chuck including an outer surface and first external threads and a second chuck, the second chuck including an outer surface and second external threads having a reverse orientation relative to the first external threads. The coupler may also include a coupler body including a first end, a second end, and a passageway extending between the first end and the second end, the first end secured to the first chuck, the second end secured to the second chuck, the first end including first internal threads engaging the first external threads, the second end including second internal threads engaging the second external threads.

20 Claims, 13 Drawing Sheets

(56) References Cited

U.S. PATENT DOCUMENTS

| | | | | |
|---|---|---|---|---|
| 4,724,639 | A * | 2/1988 | Moser | E04C 5/122 264/229 |
| 4,896,470 | A | 1/1990 | Sorkin | |
| 4,900,193 | A * | 2/1990 | MacKinnon | E02D 5/523 403/294 |
| 5,072,558 | A | 12/1991 | Sorkin et al. | |
| 5,440,842 | A | 8/1995 | Sorkin | |
| 5,701,707 | A | 12/1997 | Sorkin | |
| 5,720,139 | A | 2/1998 | Sorkin | |
| 5,749,185 | A | 5/1998 | Sorkin | |
| 5,755,065 | A | 5/1998 | Sorkin | |
| 5,770,286 | A | 6/1998 | Sorkin | |
| 5,788,398 | A | 8/1998 | Sorkin | |
| 5,839,235 | A | 11/1998 | Sorkin | |
| 5,897,102 | A | 4/1999 | Sorkin | |
| 6,012,867 | A | 1/2000 | Sorkin | |
| 6,017,165 | A | 1/2000 | Sorkin | |
| 6,023,894 | A | 2/2000 | Sorkin | |
| 6,027,278 | A | 2/2000 | Sorkin | |
| 6,098,356 | A | 8/2000 | Sorkin | |
| 6,151,850 | A | 11/2000 | Sorkin | |
| 6,176,051 | B1 * | 1/2001 | Sorkin | E04C 5/08 403/305 |
| 6,234,709 | B1 | 5/2001 | Sorkin | |
| 6,381,912 | B1 | 5/2002 | Sorkin | |
| 6,393,781 | B1 | 5/2002 | Sorkin | |
| 6,513,287 | B1 | 2/2003 | Sorkin | |
| 6,560,939 | B2 | 5/2003 | Sorkin | |
| 6,631,596 | B1 | 10/2003 | Sorkin | |
| 6,761,002 | B1 * | 7/2004 | Sorkin | E04C 5/12 403/374.1 |
| 6,817,148 | B1 | 11/2004 | Sorkin | |
| 6,843,031 | B1 | 1/2005 | Sorkin | |
| 7,424,792 | B1 | 9/2008 | Sorkin | |
| 7,676,997 | B1 | 3/2010 | Sorkin | |
| D615,219 | S | 5/2010 | Sorkin | |
| 7,823,345 | B1 | 11/2010 | Sorkin | |
| 7,841,061 | B1 | 11/2010 | Sorkin | |
| 7,856,774 | B1 | 12/2010 | Sorkin | |
| 7,866,009 | B1 | 1/2011 | Sorkin | |
| 7,950,196 | B1 | 5/2011 | Sorkin | |
| 8,015,774 | B1 | 9/2011 | Sorkin | |
| 8,065,845 | B1 | 11/2011 | Sorkin | |
| 8,069,624 | B1 | 12/2011 | Sorkin | |
| 8,087,204 | B1 | 1/2012 | Sorkin | |
| 8,251,344 | B1 | 8/2012 | Sorkin | |
| 9,097,014 | B1 | 8/2015 | Sorkin | |
| 10,196,820 | B2 * | 2/2019 | Sorkin | E04C 5/08 |
| 2002/0178665 | A1 * | 12/2002 | Campbell | E04C 5/08 52/223.13 |
| 2005/0097843 | A1 * | 5/2005 | Giesel | E04C 5/08 52/223.1 |
| 2010/0303540 | A1 * | 12/2010 | Kim | E04C 5/165 403/305 |
| 2018/0291628 | A1 * | 10/2018 | Butts | E04G 21/12 |
| 2019/0234443 | A1 * | 8/2019 | Man | F16B 7/02 |

* cited by examiner

INTERMEDIATE COUPLER FOR CONCRETE REINFORCEMENT

CROSS-REFERENCE TO RELATED APPLICATIONS

This application is a non-provisional application which claims priority from U.S. provisional application No. 62/666,530, filed May 3, 2018, which is incorporated by reference herein in its entirety.

FIELD

The present application relates to a coupler for joining reinforcing tendons in concrete.

BACKGROUND

Concrete is capable of withstanding significant compressive loads, but is more susceptible to failure when subjected to significant tensile loads. Thus, concrete structures are often reinforced with steel bars, cables, or similar to enhance the structure's ability to withstand tensile forces.

SUMMARY

A coupler is disclosed. The coupler includes a first chuck and a second chuck. The coupler also includes a coupler body including a first end, a second end, and a passageway extending between the first end and the second end, the first end secured to the first chuck, the second end secured to the second chuck. In addition, the coupler includes a cover, the cover extending along and enclosing the second chuck. Also, the coupler includes a cup, the cup covering an end surface of the first chuck, the cup in sealing engagement with the cover.

A system includes an intermediate anchor and a coupler. The coupler includes a first chuck adapted to receive an end of a first tendon, the first chuck including first external threads and a second chuck adapted to receive an end of a second tendon, the second chuck including second external threads, the second external threads having a reverse orientation relative to the first external threads. The coupler also includes a coupler body including a first end, a second end, and a passageway extending between the first end and the second end, the first end including first internal threads configured to engage the first external threads, the second end including second internal threads configured to engage the second external threads, whereby rotation of the coupler body in a first direction about the longitudinal axis of the coupler body simultaneously advances both the first chuck and the second chuck into the passageway. The coupler further includes a cover extending along the second chuck.

DETAILED DESCRIPTION

It is to be understood that the disclosure may be not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein may be for the purpose of description and should not be regarded as limiting.

The use of "including", "comprising", or "having" and variations thereof herein is meant to encompass the items listed thereafter and equivalents thereof as well as additional items. Unless specified or limited otherwise, the terms "mounted," "connected," "supported," and "secured" and variations thereof are used broadly and encompass both direct and indirect mountings, connections, supports, and couplings. Further, "connected" and "secured" are not restricted to physical or mechanical connections or couplings.

Figure 1:
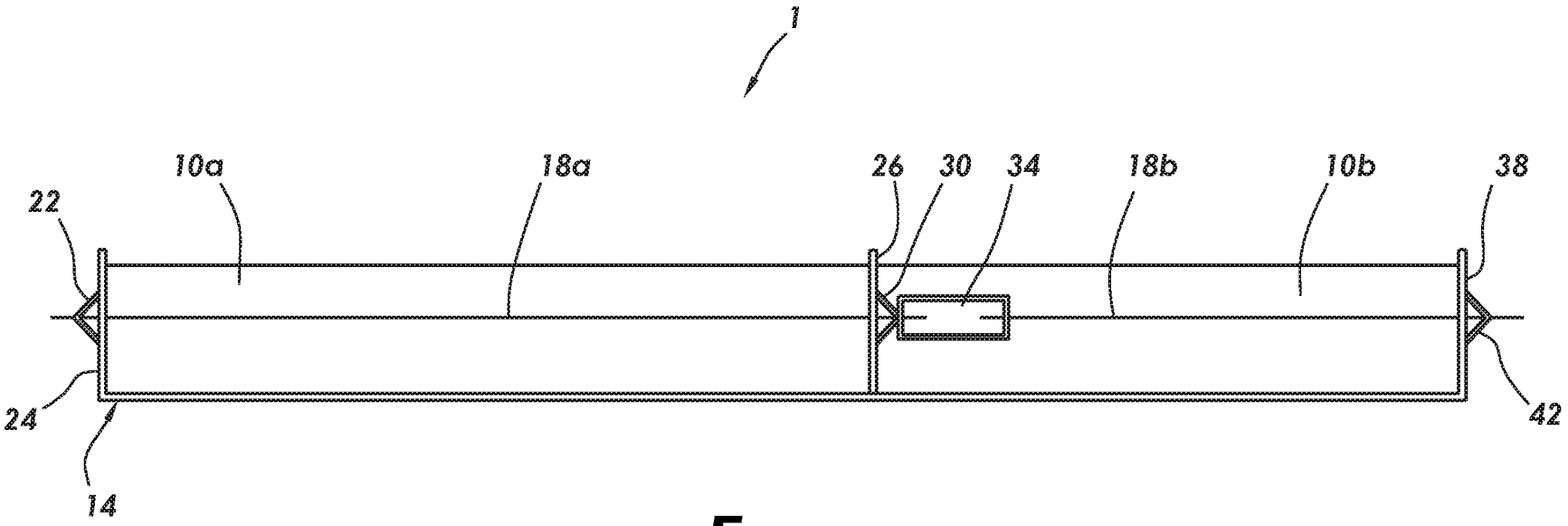
FIG. 1 is a section view of a reinforced concrete structure including a tendon.

FIG. 1 illustrates reinforced concrete structure 1 including adjacent portions 10*a*, 10*b*. Portions 10*a*, 10*b* may be formed in a framing structure 14. First and second tendons 18*a*, 18*b* may extend through portions 10*a*, 10*b*. First anchor 22 may be positioned at first end 24 of reinforced concrete structure 1 (i.e., at an end of the first portion 10*a*). One end of first tendon 18*a* may be secured to first anchor 22. First tendon 18*a* may extend through first portion 10*a* to intermediate wall or partition 26 positioned between portions 10*a*, 10*b*. Intermediate anchor 30 may be positioned adjacent partition 26, and an opposite end of first tendon 18*a* may extend through intermediate anchor 30. The opposite end of first tendon 18*a* may be secured to one end of coupler 34. One end of second tendon 18*b* may be secured to an opposite end of coupler 34, and another end of second tendon 18*b* may be extended through second portion 10*b* of concrete to another partition or an end wall 38 (i.e., an end of reinforced concrete structure 1). The other end of second tendon 18*b* may be secured to second anchor 42 positioned adjacent to end wall 38.

Although two portions 10*a*, 10*b* of concrete are shown in FIG. 1, reinforced concrete structure 1 may include additional portions positioned sequentially in an abutting (e.g., end-to-end) relationship, and/or may include more than two tendons 18*a*, 18*b*. While FIG. 1 shows a cross-section view of reinforced concrete structure 1 including one set of tendons for simplicity, reinforced concrete structure 1 may include multiple tendons positioned in parallel to tendons 18*a*, 18*b*, and/or may include multiple tendons extending in other directions through portions 10*a*, 10*b*.

Figure 2:
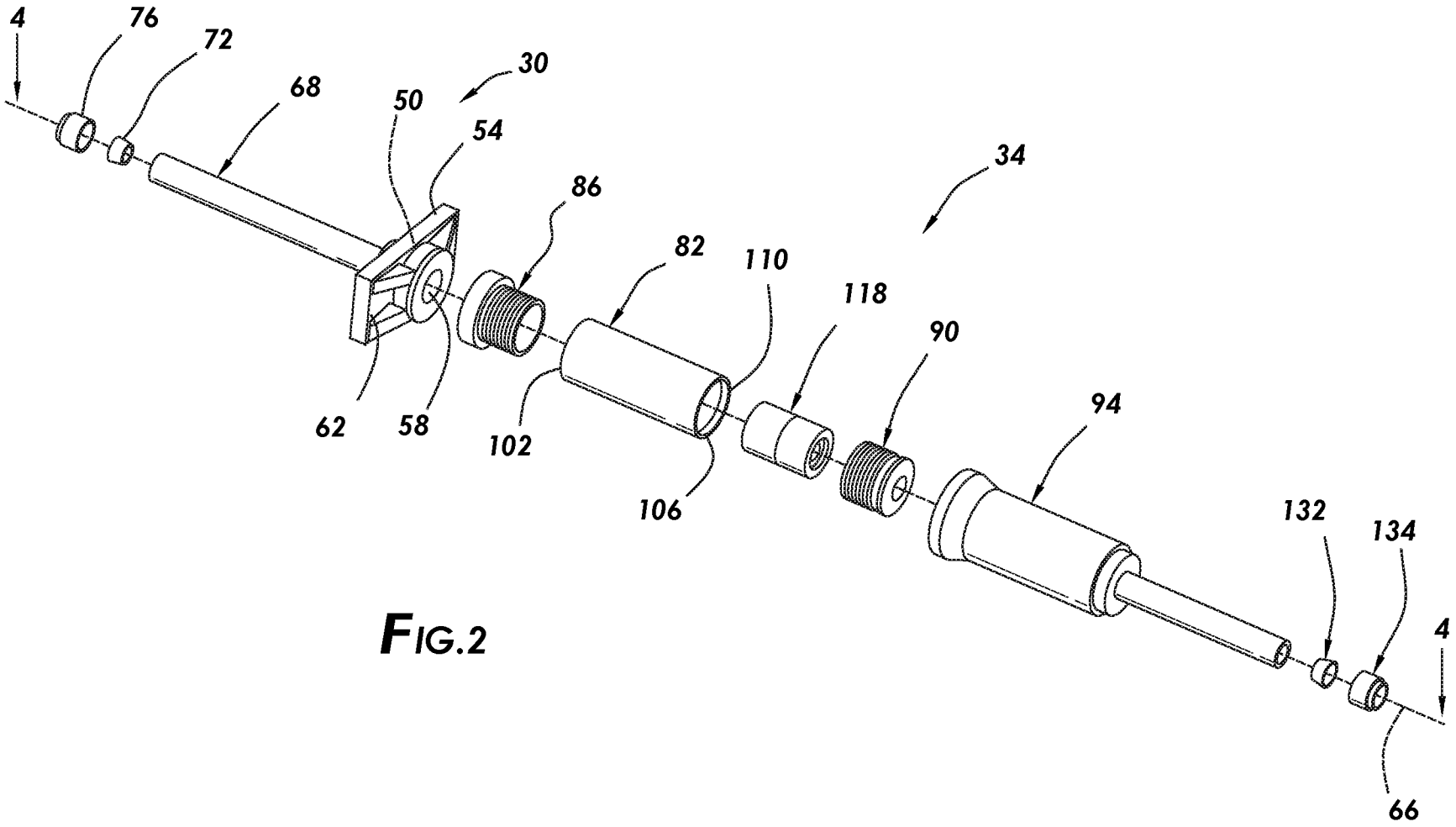
FIG. 2 is an exploded view of an intermediate anchor and coupler.
Figure 3:
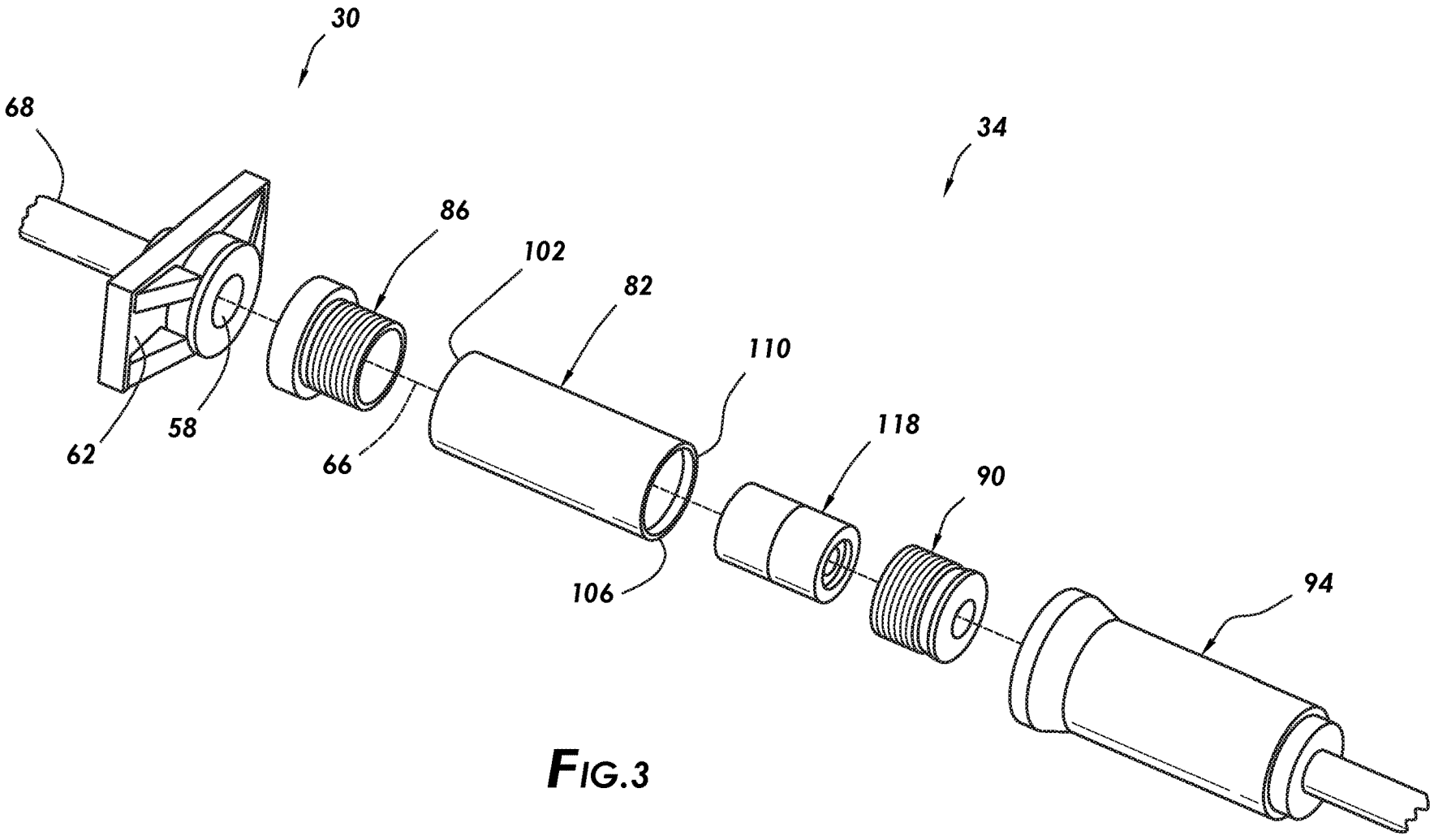
FIG. 3 is an enlarged exploded view of a portion of the intermediate anchor and coupler of FIG. 2.
Figure 4:
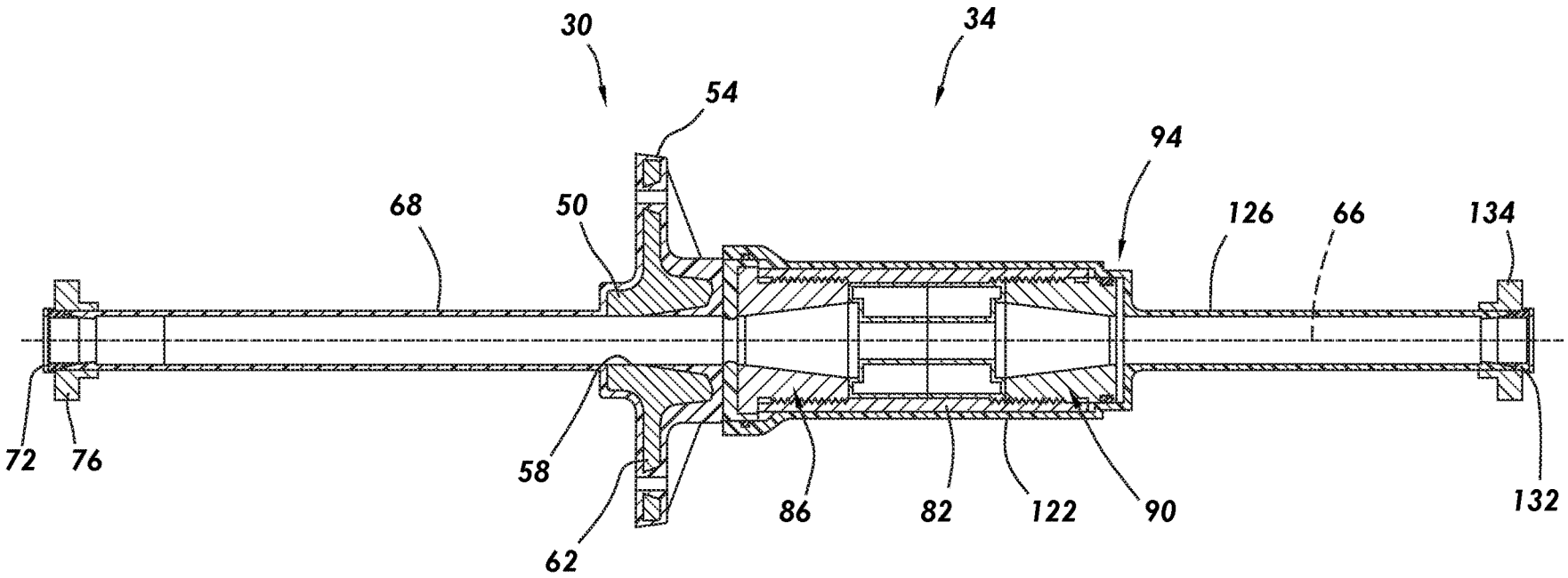
FIG. 4 is a section view of the intermediate anchor and coupler of FIG. 2, viewed along section 4-4.

FIGS. 2-4 illustrate an assembly of intermediate anchor 30 and coupler 34. In the illustrated embodiment, intermediate anchor 30 includes core 50 (FIG. 4) and encapsulation 54 covering core 50. In some embodiments, core 50 may be formed from a metal (e.g., cast steel, ductile iron, etc.), and encapsulation 54 may be formed from a polymer (e.g., high-density polyethylene). Intermediate anchor 30 further includes bore 58 and flange 62. Bore 58 extends along an axis 66 of core 50 and may receive a tendon such as, for example tendon 18*a* (FIG. 1). Flange 62 extends laterally (e.g., substantially perpendicular to) to axis 66 and provides a bearing surface against the concrete. A portion of encapsulation 54 extends beyond core 50 and along axis 66, defining encapsulation tail portion 68. Seal 72 may be positioned adjacent an end of encapsulation tail portion 68, and locknut 76 may exert a compressive force around outer surface of seal 72 and/or encapsulation tail portion 68 to provide a seal against a sheathed portion of first tendon 18*a*.

Referring now to FIG. 3, coupler 34 may include coupler body 82, first chuck 86, second chuck 90, and cover 94. In the illustrated embodiment, coupler body 82 has first end 102 and second end 106 opposite first end 102, and passageway 110 (FIG. 4) that extends through coupler body 82 from first end 102 to second end 106. Passageway 110 may be aligned with axis 66. First chuck 86 may be secured to first end 102 of coupler body 82 (e.g., by threaded engagement), and second chuck 90 may be secured to second end 106 of coupler body 82 (e.g., by threaded engagement). Although first chuck 86 and second chuck 90 are shown as being in threaded arrangement with first end 102 and second end 106 respectively, both or either may be secured by any other means known in the art, including, for example and without limitation, press fitting, mechanical welding, chemical welding, friction welding, thermal coupling or welding, electrical welding, optical welding, or beam-energy welding. In the illustrated embodiment, spacer 118 may be slidably received within passageway 110 between first chuck 86 and second chuck 90. Spacer 118 may ensure that first chuck 86 and second chuck 90 are not over-threaded into coupler body 82. In the illustrated embodiment, spacer 118 may be formed as two pieces joined together, for example, by a snap fit, or by any other means known in the art, including, for example and without limitation, press fitting, mechanical welding, chemical welding, friction welding, thermal coupling or welding, electrical welding, optical welding, or beam-energy welding.

As best shown in FIG. 4, cover 94 extends along and encloses the outside of coupler body 82 and first chuck 86 and second chuck 90. Cover 94 may be formed from the same material as encapsulation 54 of intermediate anchor 30, although in other embodiments, cover 94 may be formed from a different material than that of encapsulation 54. Cover 94 may include tubular portion 122 and cover tail portion 126 extending from tubular portion 122. Tubular portion 122 receives coupler body 82 and first chuck 86 and second chuck 90, although cover 94 may include additional spaces 130 (FIG. 5) to permit some movement between cover 94 and coupler body 82 and first chuck 86 and second chuck 90. Cover tail portion 126 extends along axis 66, and seal 132 may be positioned adjacent an end of cover tail portion 126. Locknut 134 exerts a compressive force around an outer surface of seal 132 and/or cover tail portion 126 to provide a seal against a sheathed portion of second tendon 18*b* (FIG. 1).

Figure 5:
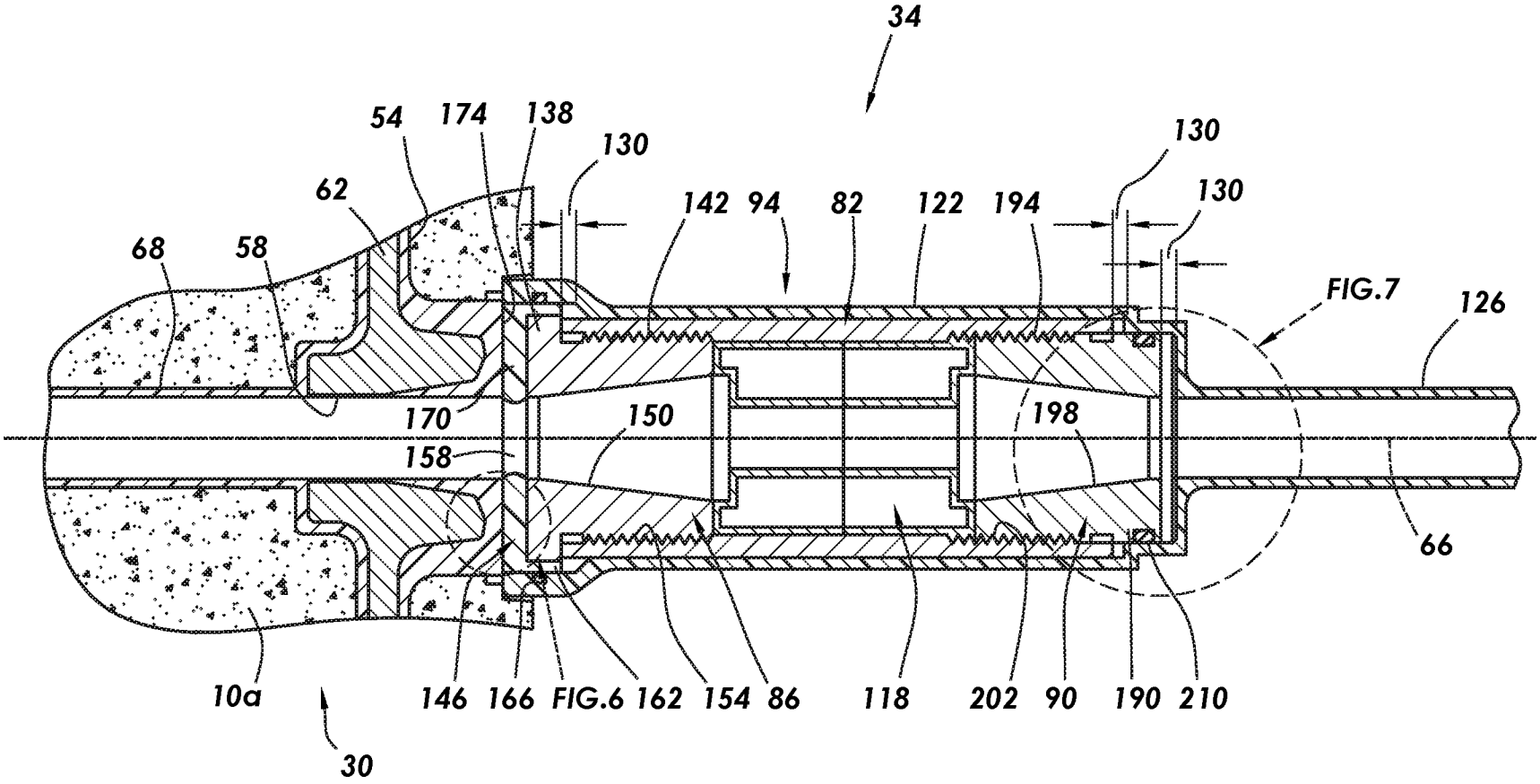
FIG. 5 is an enlarged section view of a portion of the intermediate anchor and coupler of FIG. 2, viewed along section 4-4.
Figure 7:
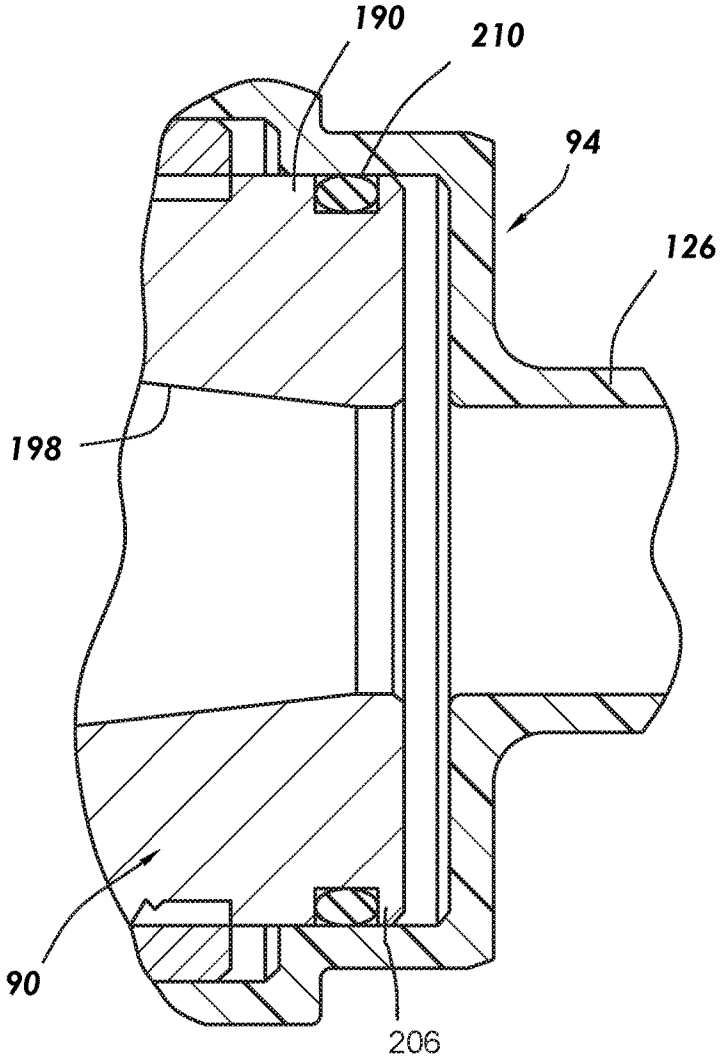
FIG. 7 is an enlarged section view of a portion of the intermediate anchor and coupler of FIG. 5.

As shown in FIG. 5, first chuck 86 may include first flange 138, first external threaded portion 142 extending from one side of first flange 138, and cup 146 covering an opposite side of first flange 138. First chuck 86 may further include first tapered chamber 150 for receiving wedges (not shown) to secure tendon 18*a* (FIG. 1) relative to first chuck 86. First external threaded portion 142 may be engaged with a first internal threaded portion 154 of first end 102 of coupler body 82, such as by threading. First external threaded portion 142 may engage first internal threaded portion 154 until first flange 138 abuts an end surface of coupler body 82 or spacer 118.

Figure 6:
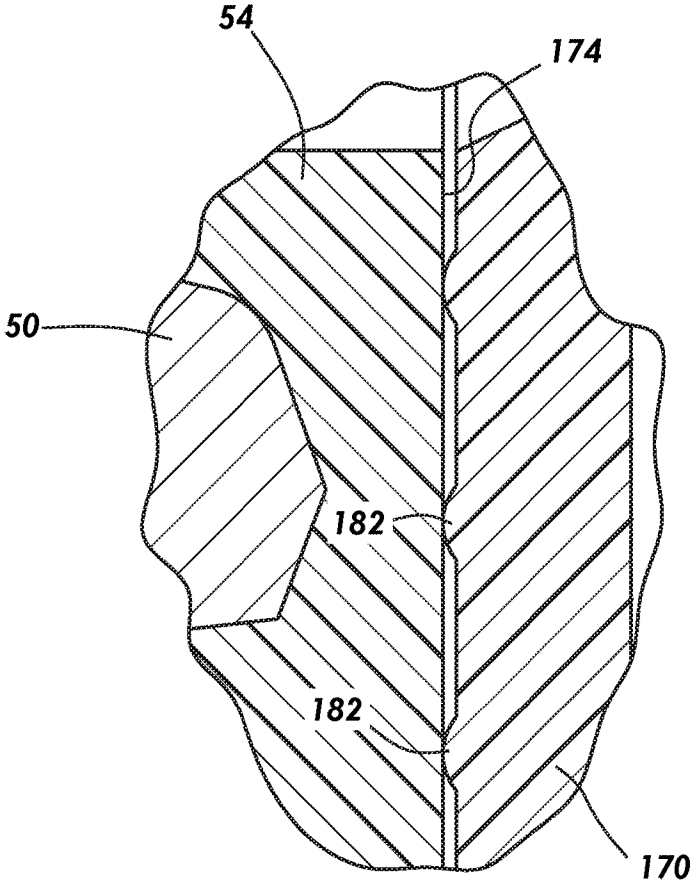
FIG. 6 is an enlarged section view of a portion of the intermediate anchor and coupler of FIG. 5.
Figure 8:
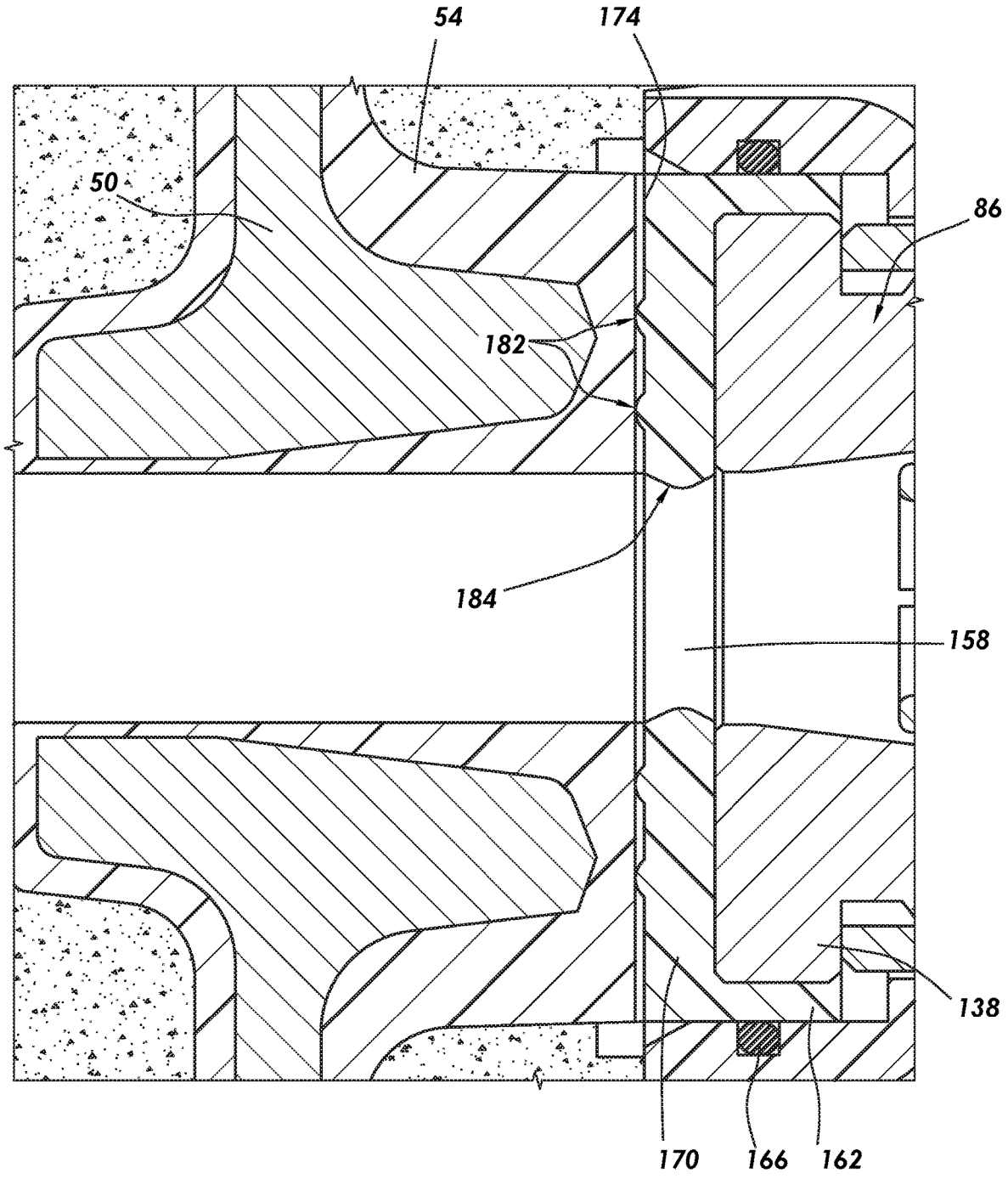
FIG. 8 is an enlarged section view of a portion of the intermediate anchor and coupler of FIG. 5.

Cup 146 may include hole 158 therethrough, aligned with axis 66 such that an end of tendon 18*a* (FIG. 1) may pass through cup 146 and into first tapered chamber 150. In some embodiments, cup 146 may be formed from the same material as cover 94. In other embodiments, cup 146 may be formed from a different material. A non-limiting material for cup 146 may be high density polypropylene. Peripheral portion 162 of cup 146 may extend over a lateral portion of first flange 138, and peripheral portion 162 may be sealed against an internal surface of cover 94, such as by O-ring 166. Planar portion 170 of cup 146 abuts end surface 174 of intermediate anchor 30. As shown in FIGS. 6 and 8, planar portion 170 of cup 146 may include protrusions 182. When tendon 18*a* is to be tensioned and fixed with wedges, the tension force draws first chuck 86 against intermediate anchor 30. As a result, protrusions 182 are pressed into encapsulation 54 of intermediate anchor 30 (FIG. 8). In addition, sealing protrusion 184 (FIG. 8) may be positioned around an inner surface of hole 158.

Referring again to FIG. 5, second chuck 90 may include second flange 190 and second external threaded portion 194 extending from one side of second flange 190. Second chuck 90 may further include second tapered chamber 198 for receiving wedges to secure tendon 18*b* (FIG. 1) relative to second chuck 90. Second external threaded portion 194 may be threadably engaged with second internal threaded portion 202 of second end 106 of coupler body 82.

In some embodiments, first threaded portions 142, 154 may each comprise multi-lead threads (for example, triple-lead threads), and second threaded portions 194, 202 may also each comprise multi-lead threads. First chuck 86 and second chuck 90 may be threaded into the coupler body 82 more quickly (i.e., in fewer rotations). In some embodiments, the threads of second external threaded portion 194 may have a direction that is in reverse orientation with respect to the threads of first external threaded portion 142 of first chuck 86. For example, if first external threaded portion 142 includes right-hand threads, second external threaded portion 194 may include left-hand threads. As a result, rotation of coupler body 82 in a single direction can cause both first chuck 86 and second chuck 90 to advance into coupler body 82 simultaneously. Furthermore, in some embodiments, peripheral portion 206 of second flange 190 may be sealed, such as by O-ring 210, against an inner surface of cover 94.

During fabrication of reinforced concrete structure 1, tendon 18*a* may be first secured to first anchor 22. Intermediate anchor 30 may be positioned adjacent partition 26 and cup 146 may abut end surface 174 of intermediate anchor 30. First tendon 18*a* may be covered in a sheath and extended through intermediate anchor 30 and cup 146. A pocket former may be positioned adjacent intermediate anchor 30 and cup 146 to prevent or restrict concrete from completely embedding intermediate anchor 30 during formation of first concrete portion 10*b*. In some embodiments, cup 146 may act as a grout-exclusion plug during concrete placement. Concrete may be then poured into first portion 10*a*. After the concrete has set such that the concrete has a predetermined minimum compressive strength, first chuck 86 may be positioned over first tendon 18*a* and a sheath-cutting tool may remove a portion of the tendon sheath from the end. Wedges may be positioned in first tapered chamber 150 and tendon 18*a* may be tensioned such as by a hydraulic tensioner. As tension is applied, the wedges are forced into first tapered chamber 150 to secure tendon 18*a* within first chuck 86. An excess portion of tendon tail (i.e., the portion extending beyond a minimum protruding from first chuck 86) may be removed.

An end of second tendon 18*b* extends through second chuck 90, and wedges may be positioned in second tapered chamber 198 to secure the end of second tendon 18*b* to second chuck 90. Spacer 118 may be positioned within coupler body 82 of coupler 34, and coupler body 82 may be positioned between first chuck 86 and second chuck 90. In certain embodiments, because of the reverse threads on first external threaded portion 142 and second extended threaded portion 194, coupler body 82 may be rotated in a single direction to simultaneously advance both first chuck 86 and second chuck 90 into coupler body 82. Coupler body 82 and chucks 86, 90 join or splice tendons 18*a*, 18*b*. The tensioning force exerted on tendons 18*a*, 18*b* may be transmitted through intermediate anchor 30, through first chuck 86 and second chuck 90 via the wedges, and through coupler body 82 connecting first chuck 86 and second chuck 90. Cover 94 may be positioned over coupler body 82 and first chuck 86 and second chuck 90, and sealed against cup 146 on one end and against the sheathed tendon 18*b* on the other end.

The opposite end of tendon 18*b* may extend through second anchor 42 on an opposite end of second portion 10*b*. If second portion 10*b* is to be the final concrete portion to be cast for reinforced concrete structure 1, second tendon 18*b* may be tensioned, cut, and secured to second anchor 42 after concrete portion 10*b* is poured and set. Otherwise, the process may be repeated to connect tendon 18*b* to an additional tendon extending through additional concrete sections.

Cover 94 may seal against cup 146, which in turn seals against the sheath of tendon 18*a*. Tendons 18*a*, 18*b* and components of coupler 34 are sealed against moisture. Intermediate anchor 30 provides a temporary load bearing function until second tendon 18*b* can be joined and tensioned, but tendons 18*a*, 18*b* and coupler components may remain covered and sealed. The sealing of the internal components may be independent of an interface between intermediate anchor 30 and coupler 34.

Figure 9:
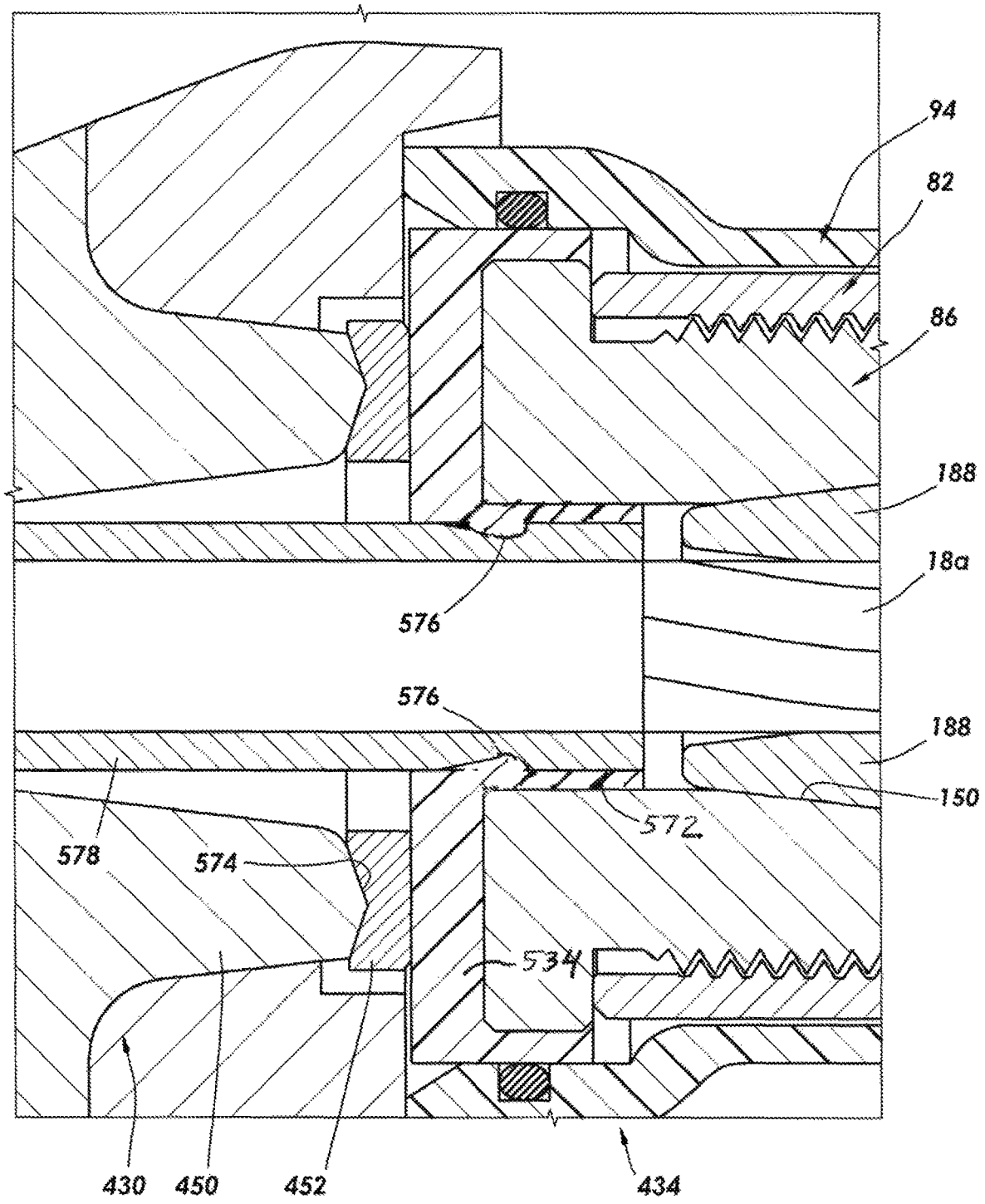
FIG. 9 is an enlarged section view of a portion of an intermediate anchor and coupler according to another embodiment.
Figure 10:
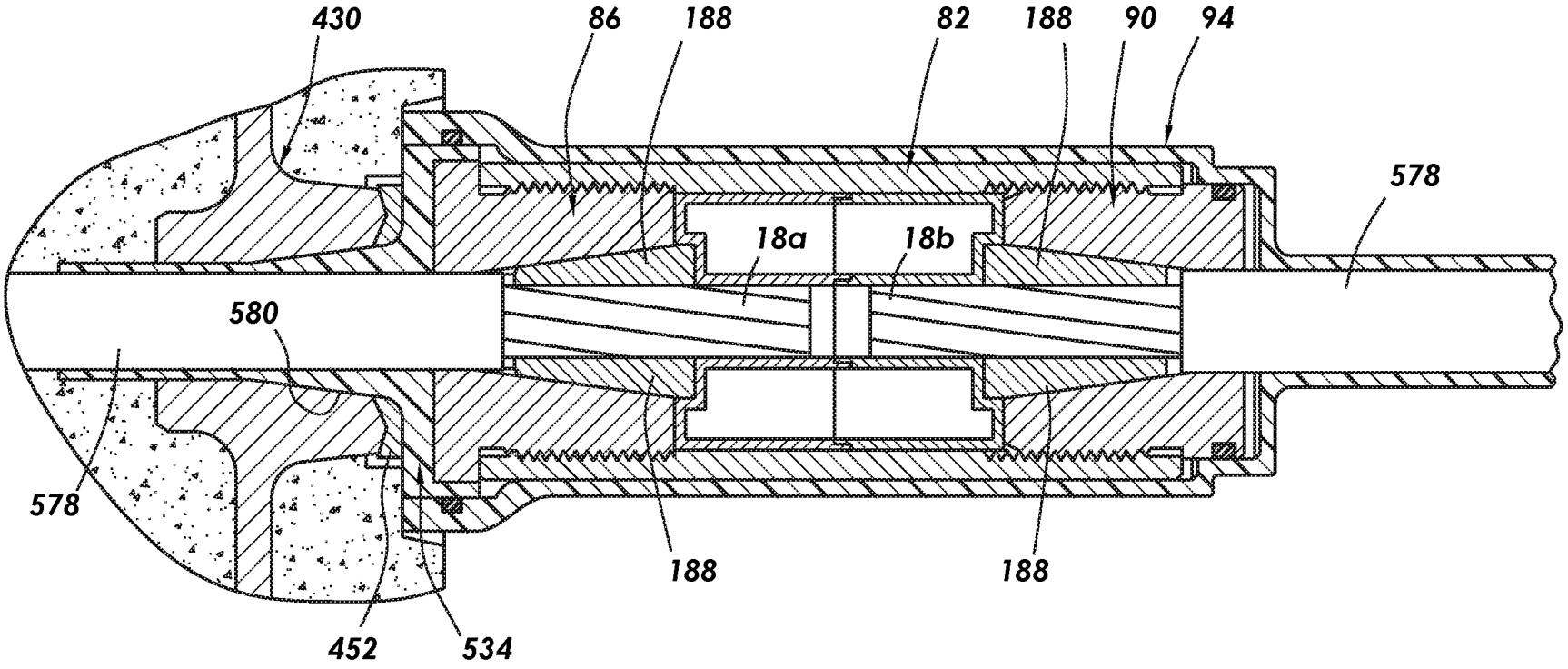
FIG. 10 is a section view of an intermediate anchor and coupler according to another embodiment.

FIG. 9 illustrates an intermediate anchor 430 and coupler 434 according to another embodiment of the present disclosure. In the embodiment of FIG. 9, intermediate anchor 430 does not include an encapsulation, but only core 450. Washer 452 may be positioned adjacent end surface 574 of intermediate anchor 430, between intermediate anchor 430 and cup 534. Furthermore, cup 534 includes throat 572 that extends through a portion of first chuck 86, toward first tapered chamber 150 without extending into first tapered chamber 150. Throat 572 may include one or more sealing protrusions 576 to engage an outer surface of sheath 578 of tendon 18*a* and prevent or restrict moisture from penetrating into the unsheathed portion of tendon 18*a* in first tapered chamber 150 where wedges 188 engage tendon 18*a*. In other embodiments (FIG. 10), cup 534 may include a neck 580 extending into a chamber of intermediate anchor 430 and sealing against sheath 578 of tendon 18*a*.

Figure 11:
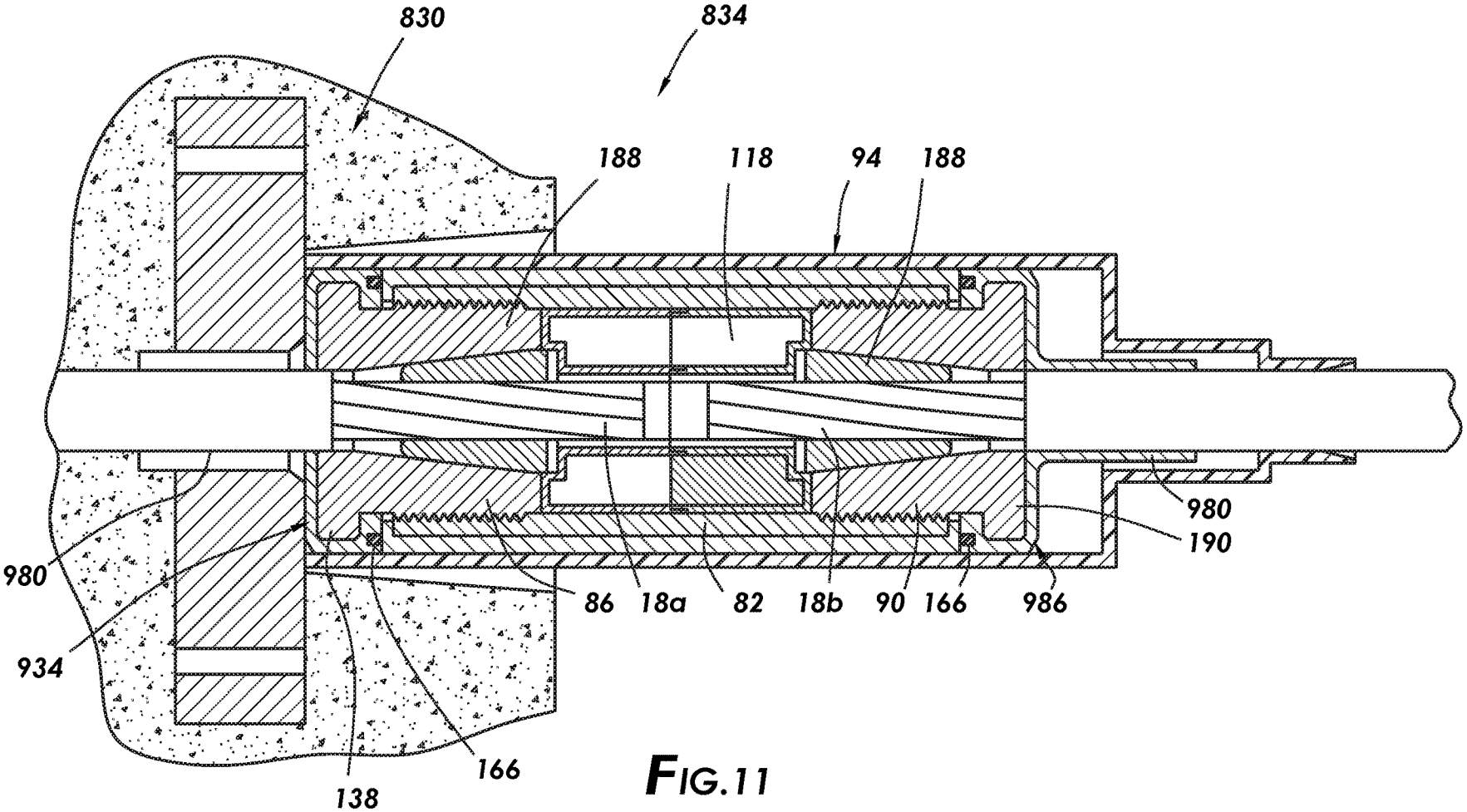
FIG. 11 is a section view of an intermediate anchor and coupler according to another embodiment.

FIG. 11 illustrates yet another embodiment of an intermediate anchor 830 and coupler 834. Intermediate anchor 830 may comprise an unencapsulated load plate against which first cup 934 may be compressed by first chuck 86. In addition, an end of cover 94 extends into abutment with the unencapsulated load plate. First cup 934 may be positioned on first flange 138 on first chuck 86 and a second cup 986 may be positioned on a second flange 190 on second chuck 90. Each cup 934, 986 may include an inner annular surface that may be sealed against an end surface of coupler body 82, such as by O-rings 166. Each cup 934, 986 may also include neck 980.

Figure 12:
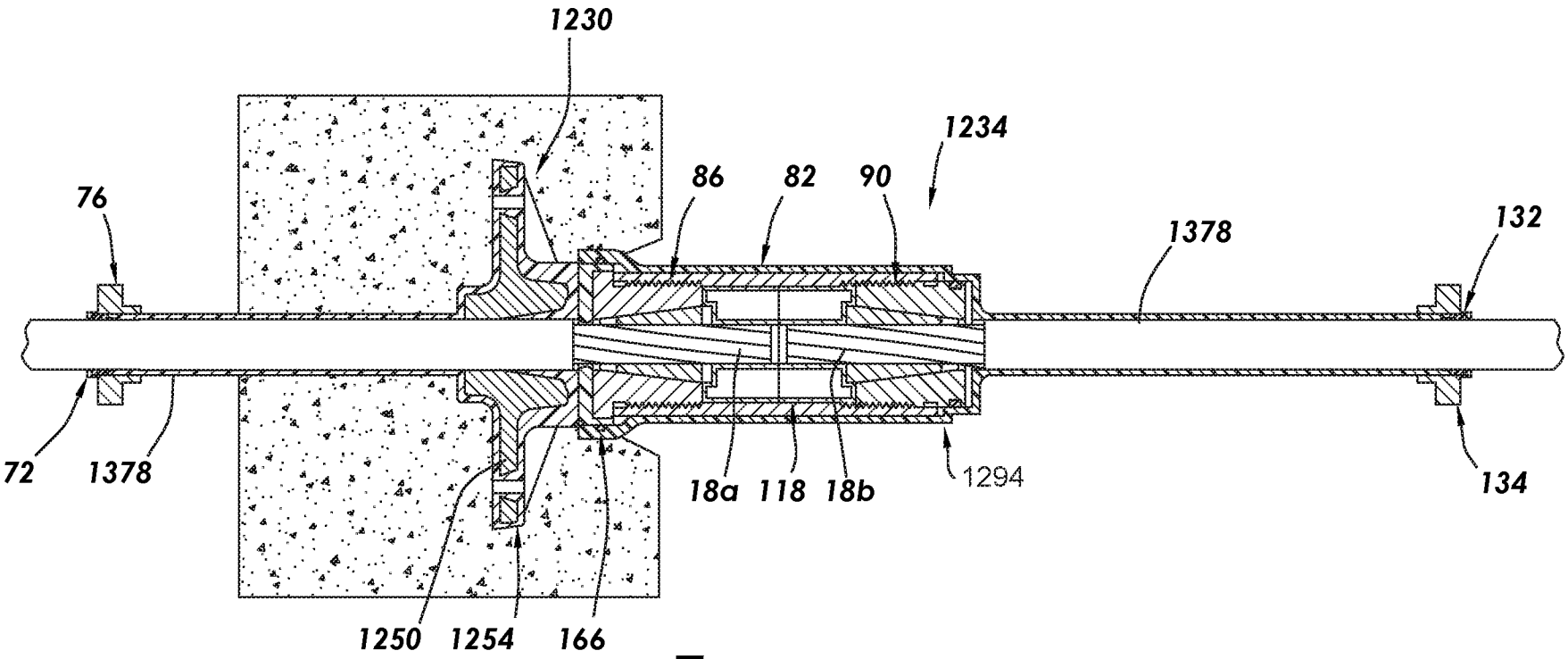
FIG. 12 is a section view of an intermediate anchor and coupler according to another embodiment.
Figure 13:
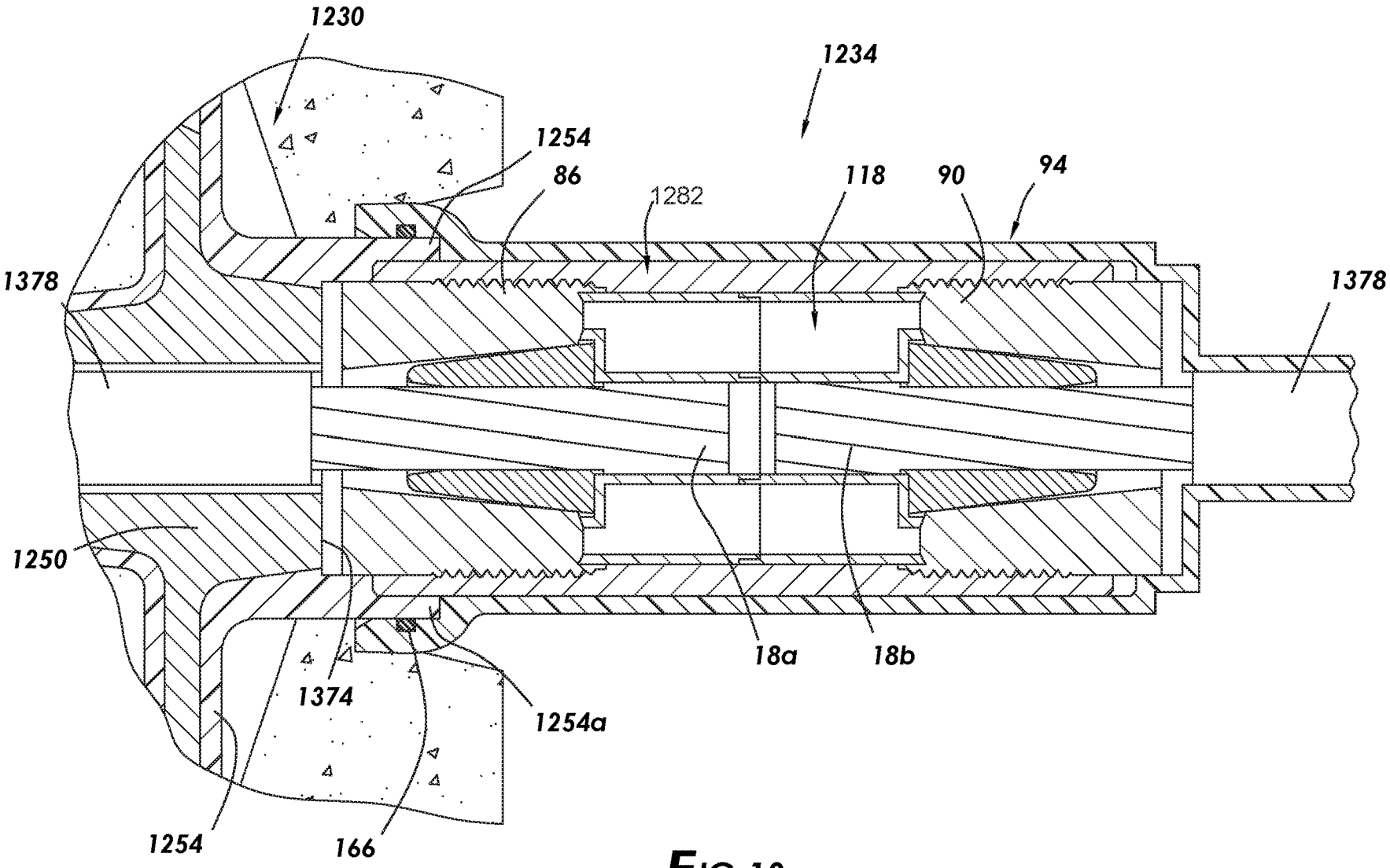
FIG. 13 is an enlarged section view of the intermediate anchor and coupler of FIG. 12.
Figure 14:
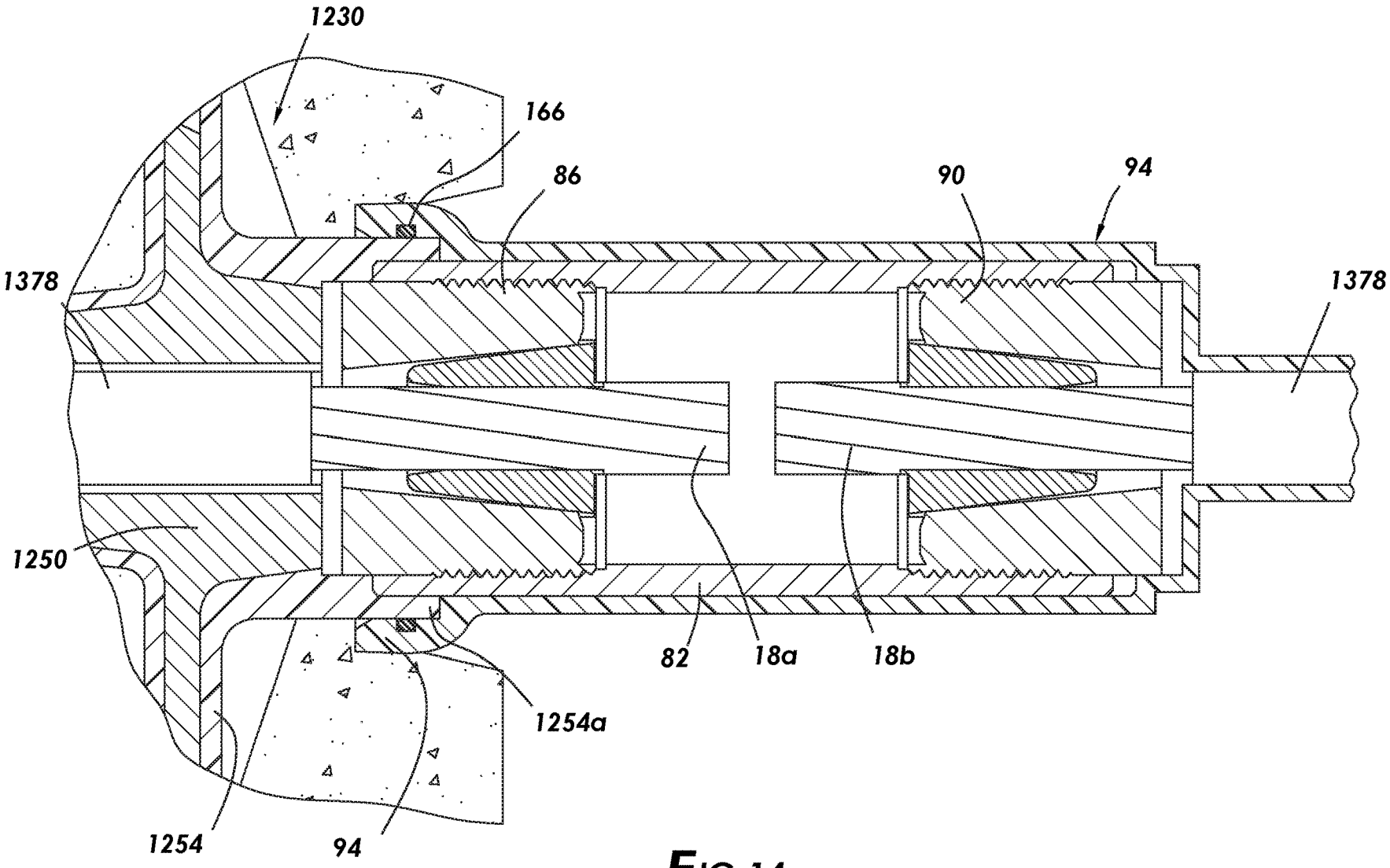
FIG. 14 is a section view of an intermediate anchor and coupler according to another embodiment.

FIGS. 12-14 illustrate yet another embodiment of an intermediate anchor 1230 and coupler 1234 connecting tendons 18*a*, 18*b* having sheaths 1378. Intermediate anchor 1230 may include core 1250 that may be encapsulated. Also, as best shown in FIG. 13, first chuck 86 may engage directly against end surface 1374 of core 1250, and a portion of encapsulation 1254*a* may extend beyond the end of core 1250 and over the coupler body 1282 of coupler 1234. An end of cover 1294 adjacent to first chuck 86 may be sealed, for example, by an O-ring 166, against an outer surface of portion of encapsulation 1254*a*.

The independent embodiments described above and illustrated in the figures are presented by way of example only and are not intended as a limitation upon the concepts and principles of the present disclosure. As such, it will be appreciated that various changes in the elements and their configuration and arrangement are possible without departing from the spirit and scope of the present disclosure. One or more independent advantages and/or independent features may be set forth in the claims.

What is claimed is:

1. A coupler, the coupler comprising:

a first chuck, the first chuck including an outer surface and first external threads;

a second chuck, the second chuck including an outer surface and second external threads having a reverse orientation relative to the first external threads; and a coupler body including a first end, a second end, and a passageway extending between the first end and the second end, the first end secured to the first chuck, the second end secured to the second chuck, the first end including first internal threads engaging the first external threads, the second end including second internal threads engaging the second external threads;

a cover that extends along and encloses the second chuck, and a cup covering an end surface of the first chuck, wherein the cup includes a tapered neck extending longitudinally away from the first chuck.

2. The coupler of claim 1 wherein the first chuck includes a first tapered chamber and wedges positioned in the first tapered chamber and wherein the second chuck includes a second tapered chamber and wedges positioned in the second tapered chamber.

3. The coupler of claim 1, further comprising a spacer positioned in the passageway between the first chuck and the second chuck.

4. The coupler of claim 1, wherein the first chuck includes a first flange, wherein a peripheral portion of the cup extends over a portion of the first flange.

5. The coupler of claim 1 wherein the cup includes a planar portion that includes protrusions.

6. The coupler of claim 1 wherein the cover includes a tubular portion and a cover tail portion that extends from the tubular portion, wherein the cover encloses the coupler body and the first and second chucks, and wherein the cover tail portion extends along an axis of the coupler body.

7. The coupler of claim 1 wherein the first external threads and the first internal threads are multi-lead threads, and wherein the second external threads and second internal threads are multi-lead threads.

8. A coupler, the coupler comprising:

a first chuck;

a second chuck;

a coupler body including a first end, a second end, and a passageway extending between the first end and the second end, the first end secured to the first chuck, the second end secured to the second chuck;

a cover, the cover extending along and enclosing the second chuck; and a cup, the cup covering an end surface of the first chuck, the cup in sealing engagement with the cover, wherein the cup is positioned between an end surface of the first chuck and an end surface of an intermediate anchor, wherein the cup includes a planar portion that abuts an end surface of the intermediate anchor, and wherein the planar portion of the cup includes protrusions.

9. The coupler according to claim 8 wherein the first chuck has first external threads, wherein the second chuck has second external threads having a reverse orientation relative to the first external threads; and wherein the first end of the coupler body includes first internal threads engaging the first external threads and the second end of the coupler body includes second internal threads engaging the second external threads.

10. The coupler of claim 9 wherein the first external threads and the first internal threads are multi-lead threads, and wherein the second external threads and second internal threads are multi-lead threads.

11. The coupler of claim 9 wherein the first chuck includes a first tapered chamber and wedges positioned in the first tapered chamber and wherein the second chuck includes a second tapered chamber and wedges positioned in the second tapered chamber.

12. The coupler of claim 9, further comprising a spacer positioned in the passageway between the first chuck and the second chuck.

13. A system comprising:

an intermediate anchor including a tapered intermediate anchor chamber;

a coupler, the coupler comprising:

a first chuck adapted to receive an end of a first tendon, the first chuck including first external threads;

a second chuck adapted to receive an end of a second tendon, the second chuck including second external threads, the second external threads having a reverse orientation relative to the first external threads;

a coupler body including a first end, a second end, and a passageway extending between the first end and the second end, the first end including first internal threads configured to engage the first external threads, the second end including second internal threads configured to engage the second external threads, whereby rotation of the coupler body in a first direction about the longitudinal axis of the coupler body simultaneously advances both the first chuck and the second chuck into the passageway;

a cover extending along the second chuck; and a cup covering an end surface of the first chuck, the cup including a tapered neck extending longitudinally away from the first chuck and extending into the tapered intermediate anchor chamber.

14. The system according to claim 13, further including a cup covering an end surface of the first chuck, the cup in sealing engagement with an end of the cover.

15. The system according to claim 14 wherein the cup includes a planar portion that abuts an end surface of the intermediate anchor and the planar portion of the cup includes protrusions.

16. The system according to claim 13 wherein the intermediate anchor includes a core and an encapsulation surrounding the core, wherein a portion of the encapsulation extends beyond the core and defines an encapsulation tail portion, the encapsulation tail portion being adapted to receive a sheathed portion of a tendon therein.

17. The system according to claim 13 wherein the cover encloses the coupler body and the first and second chucks, wherein the cover includes a cover tail portion, and wherein the cover tail portion extends along an axis of the coupler body and is adapted to receive a sheathed portion of a tendon therein.

18. The system of claim 13 wherein the first external threads and the first internal threads are multi-lead threads, and wherein the second external threads and second internal threads are multi-lead threads.

19. The system of claim 13 wherein the first chuck includes a first tapered chamber and wedges positioned in the first tapered chamber configured to engage an outer surface of the first tendon and wherein the second chuck includes a second tapered chamber and wedges positioned in the second tapered chamber configured to engage an outer surface of the second tendon.

20. The system of claim 13, further comprising a spacer positioned in the passageway between the first chuck and the second chuck.

* * * * *